US009829174B2

(12) United States Patent
Schouboe

(10) Patent No.: US 9,829,174 B2
(45) Date of Patent: Nov. 28, 2017

(54) ILLUMINATION DEVICE WITH UNIFORM LIGHT BEAMS

(71) Applicant: Martin Professional ApS, Arhus (DK)

(72) Inventor: Henrik Schouboe, Aarhus C (DK)

(73) Assignee: MARTIN PROFESSIONAL APS, Arhus N (DK)

( * ) Notice: Subject to any disclaimer, the term of this patent is extended or adjusted under 35 U.S.C. 154(b) by 228 days.

(21) Appl. No.: 14/733,866

(22) Filed: Jun. 8, 2015

(65) Prior Publication Data

US 2015/0362147 A1 Dec. 17, 2015

(30) Foreign Application Priority Data

Jun. 12, 2014 (EP) ..... 14172100

(51) Int. Cl.

| | |
|---|---|
| ***F21V 5/00*** | (2015.01) |
| ***F21V 14/06*** | (2006.01) |
| ***F21V 23/00*** | (2015.01) |
| ***F21V 7/00*** | (2006.01) |
| ***F21V 13/14*** | (2006.01) |
| *F21Y 107/50* | (2016.01) |

(Continued)

(52) U.S. Cl.

CPC ..... *F21V 5/007* (2013.01); *F21V 5/008* (2013.01); *F21V 7/0083* (2013.01); *F21V 13/14* (2013.01); *F21V 14/06* (2013.01); *F21V 23/003* (2013.01); *F21S 10/00* (2013.01); *F21V 7/043* (2013.01); *F21V 17/02* (2013.01); *F21V 29/80* (2015.01); *F21W 2131/406* (2013.01);

(Continued)

(58) Field of Classification Search

CPC ..... F21V 5/007; F21V 5/008; F21V 13/00; F21V 13/02; F21V 13/12; F21V 14/06; F21V 23/003; F21V 7/0083; F21V 7/043; F21V 17/02; F21Y 2107/50; F21Y 2107/60; F21Y 2113/00; F21W 2131/406; F21S 10/00

USPC ..... 362/242, 243

See application file for complete search history.

(56) References Cited

U.S. PATENT DOCUMENTS 6,402,347 B1 * 6/2002 Maas ..... F21V 5/007 315/312

7,070,310 B2 * 7/2006 Pond ..... B60Q 1/04 362/516

(Continued)

FOREIGN PATENT DOCUMENTS

| | | |
|---|---|---|
| CN | 201 180 949 Y | 1/2009 |
| JP | 2008218089 A | 9/2008 |
| WO | 2011131197 A1 | 10/2011 |

OTHER PUBLICATIONS

European Search Report for Application No. EP 14 17 2100 dated Nov. 7, 2014.

*Primary Examiner* — Alan Cariaso

(74) *Attorney, Agent, or Firm* — Artegis Law Group, LLP

(57) ABSTRACT

The invention relates to an illumination device comprising a group of first light sources, a plurality of optical lenses, a plurality of beam generating elements, where each of the beam generating elements is configured to collect the light of at least one first light source to generate a light beam of the collected light and to pass the generated light beam to one of the optical lenses, a group of second light sources, and a plurality of shielding elements, where each shielding element is arranged between at least one of the second light sources and one of the plurality of optical lenses in such a way that said at least one of the second light source illuminates only one of the plurality of optical lenses.

10 Claims, 10 Drawing Sheets

(51) Int. Cl.

| | |
|---|---|
| *F21S 10/00* | (2006.01) |
| *F21V 7/04* | (2006.01) |
| *F21V 17/02* | (2006.01) |
| *F21W 131/406* | (2006.01) |
| *F21Y 113/00* | (2016.01) |
| *F21V 29/80* | (2015.01) |
| *F21Y 115/10* | (2016.01) |

(52) U.S. Cl.
CPC ..... *F21Y 2107/50* (2016.08); *F21Y 2113/00* (2013.01); *F21Y 2115/10* (2016.08)

(56) References Cited

U.S. PATENT DOCUMENTS

| | | | | |
|---|---|---|---|---|
| 8,061,868 | B2 * | 11/2011 | Dubord | B60Q 1/24 362/232 |
| 8,820,963 | B2 * | 9/2014 | Olsen | F21V 5/007 315/151 |
| 2005/0073848 | A1 | 4/2005 | King et al. | |
| 2006/0083016 | A1 | 4/2006 | Okamura et al. | |
| 2010/0109531 | A1 | 5/2010 | Helms et al. | |
| 2011/0280031 | A1 | 11/2011 | Luger et al. | |
| 2011/0285292 | A1 | 11/2011 | Mollnow et al. | |
| 2013/0170222 | A1 * | 7/2013 | Lin | F21V 14/06 362/309 |
| 2013/0294045 | A1 | 11/2013 | Morgenbrod | |
| 2014/0133142 | A1 | 5/2014 | Jørgensen | |
| 2014/0316742 | A1 * | 10/2014 | Sun | G02B 19/0066 702/167 |

* cited by examiner

ILLUMINATION DEVICE WITH UNIFORM LIGHT BEAMS

CROSS-REFERENCE TO RELATED APPLICATIONS

The present application claims priority to European patent application titled, "ILLUMINATION DEVICE WITH UNIFORM LIGHT BEAMS," filed on Jun. 12, 2014 and having Application No. 14 172 100.1. The subject matter of this related application is hereby incorporated herein by reference.

TECHNICAL FIELD

The present invention relates to an illumination device with light beams.

BACKGROUND

Illumination devices or light fixtures creating different light effects are used in different fields of application, inter alia in the entertainment industry or as part of an architectural installation.

Illumination devices can generate a light beam having a certain beam width and a certain divergence and can inter alia generate a light beam with a uniform light distribution. Furthermore, the illumination devices may be adapted to project an image onto a target surface. Recently, LEDs (light emitting diodes) have replaced the former light sources in the illumination devices. Multiple LEDs emitting different colours often replace a single light source. This, however, changes the visible appearance of the illumination device, as the multiple LED light sources are exposed to the viewer and the light emits from a larger area. If single colour LEDs are used in a colour mixing version to generate a colour, then all the LED colours might be visible. However, the appearance of multiple light dots may be not satisfying.

WO 2011/131197 discloses an illumination device with a first group of light sources which illuminate different optical lenses to which for each optical lens a light beam is generated. Furthermore, a second group of light sources is provided generating a background light for the parts of the illumination device between the optical lenses. A need exists to further increase the flexibility when generating light beams in an illumination device.

SUMMARY

This need is met by the features of the independent claims. The dependent claims describe further embodiments.

According to a first aspect, an illumination device is provided comprising a group of first light sources and a plurality of optical lenses. Furthermore, a plurality of beam generating elements are provided wherein each of the beam generating elements is configured to collect the light of at least one first light source and is furthermore configured to generate a light beam of the collected light. Furthermore, the beam generating element is configured to pass the generated light beam to one of the optical lenses. The illumination device furthermore comprises a group of second light sources and a plurality of shielding elements. Each shielding element is arranged between at least one of the second light sources and one of the plurality of optical lenses in such a way that said at least one of the second light sources illuminates only one of the plurality of optical lenses. In other words, each shielding element is arranged such that it prevents the light emitted by said at least one second light source to illuminate another than said one optical lens so that the light of each of the second light sources illuminates one of the plurality of optical lenses.

This illumination device has the first light sources with which the optical lenses can be illuminated and with the result that a plurality of light beams exist at the optical lenses. With the use of the shielding elements, the second light sources can also be used to illuminate the optical lenses. As the beam generated by the first light sources may be different from the light beam generated by the second light sources and the corresponding shielding element, the illumination device can generate light beams of a variety of shapes so that in total the flexibility in generating light beams is increased. In addition, the second light sources can be configured to illuminate the optical lenses without generating light beams and the front surface of the illumination device can as a result provide a graphical display where the optical lenses act as pixels without generating a light beam.

Details of the invention and further embodiments will become apparent from the following detailed description.

DETAILED DESCRIPTION

Figure 1A:
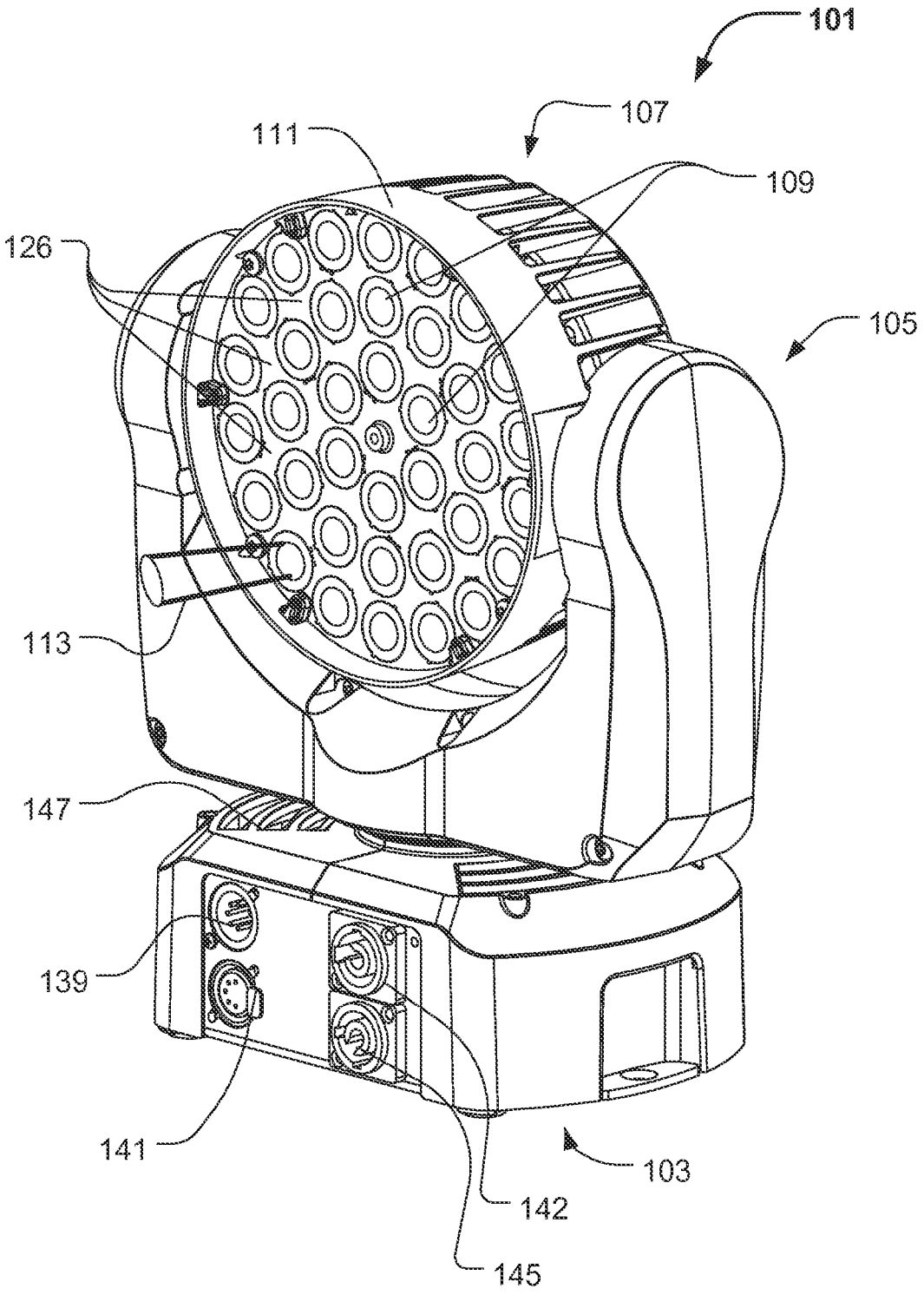
Fig. 1a (Prior art)
FIGS. 1*a* and 1*b* illustrate an example of a moving head illumination device known from the prior art.

The present invention relates to an illumination device designed as described in a moving head lighting fixture including a number of LEDs that generate a light beam, however the person skilled in the art realizes that the present invention relates to illumination devices using any kind of light source such as discharge lamps, OLEDs, PLEDs, plasma sources, halogen sources, fluorescent light sources, etc. and/or combinations thereof. It is to be understood that the illustrated embodiments are simplified and illustrate the principles of the present invention rather than showing an exact embodiment. The skilled person will thus understand that the present invention can be embodied in many different ways and also comprise further components in addition to the shown components. The illumination device can comprise a group of first light sources, a plurality of optical lenses, beam generating elements, and a group of second light sources. Furthermore, shielding elements are provided guiding the light from the second light sources to one of the optical lenses.

The illumination device may furthermore comprise a plurality of diffusing elements wherein each of the diffusing elements is arranged between at least one second light source and the corresponding optical lens such that the light emitted by said at least one second light source passes one of the diffusing elements before passing the corresponding optical lens.

When the light emitted by the second light sources passes through a diffusing element before passing the optical lens, the light is further diffused so that a less focused light beam compared to the light beam generated by the first light sources is generated. With the diffusion elements, a more homogenous, wider light beam can be generated that passes one of the optical lenses. Furthermore, with the diffusing elements, the single light dots generated by the second light sources are less visible to a viewer so that a more uniform even light is generated. In addition, the diffusing element can also assist in creating a homogenous illumination of the optical lenses by light from the second light sources resulting in the effect that each of the front lenses appears as single homogenous light beam.

The diffusing element can contain an aperture wherein one of the beam generating elements passes through the aperture. The group of first light sources can be arranged on a first circuit board, and the group of second light sources can be arranged on another second circuit board. It is possible that the first light source is provided on the first circuit board allocated in the direction of the light from the first light sources to the plurality of optical senses behind the second light sources so that the second light sources provided on a second circuit board are located between the first light sources and the plurality of optical senses. In another embodiment, both groups of light sources, the first and second light sources, may be provided on the same circuit board.

Each shielding element can be formed as a hollow or tubular body enclosing at least one second light source. The hollow body then limits the light emitted by one second light source in such a way that the light emitted from a second light source hits only one of the optical lenses. Furthermore, as the shielding element separates light from one second light source from light emitted by another second light source illuminating another optical lens, different optical effects can be obtained for different optical lenses.

Each hollow body as shielding element may be located with one of the end surfaces on one of the circuit boards wherein at least one diffusing element is arranged on the other end surface of the hollow cylinder. In this embodiment, a diffusing element may close the hollow body at its upper part so that the light generated by the second light sources enclosed by the hollow body passes through a diffusing element before passing one of the optical lenses.

A diffusing element can close one end surface of the hollow body with the exception of a central part of the hollow body where the beam generating element of the first light source is provided. In this embodiment, the end surface of the hollow body facing the optical lenses is covered with a diffusing element in the part of the end surface where the light of at least one second light source is transmitted to a corresponding optical lens. The other part of the end surface is not covered by the diffusing element. Through this other part, the light emitting from the beam generating element is directly passed to the optical lens.

The illumination device may further comprise a first driver for driving the group of first light sources and a plurality of second drivers provided for driving the group of second light sources. A subgroup of the second light sources can be provided to illuminate one of the plurality of optical lenses, wherein one second driver is provided to drive the second light sources of each subgroup. In this embodiment, one second driver is provided for driving the light sources illuminating one optical lens wherein a single first driver is provided to drive all first light sources. The electric power used to drive each of the first light sources can be at least ten times higher than the electric power used to drive each of the light sources. This provides a cost effective solution for driving the different group of light sources. As a driver driving a high power first light source is much more expensive than a lower power driver driving the second light sources, a system is obtained in which only a single high power driver is used with a plurality of low power, more cost-effective second drivers. As a result, the optical lenses can act a plurality of pixels in a graphical display in a cost-efficient way.

The first light sources that are provided on the first circuit board may be provided in direction of the light from the first light source to the plurality of optical lenses behind the second light sources. This means that the second light sources provided on the second circuit board are located between the first light sources and the plurality of optical lenses. When the first circuit board with the first light sources is located behind the second circuit board, the beam generating elements pass through the second circuit board and substantially extend to the front surface of the shielding elements or beyond.

When the second light source is used to illuminate one optical lens, at least two second light sources may be used to illuminate an optical lens in order to obtain a more uniform light distribution on the optical lens.

It should be taken into account that each of the features described above or described in further detail below may be used in the described context. However, each of the features may also be used alone or in combination with any of the other features described above or below.

The illumination device can furthermore comprise an actuator which can move the optical lenses relative to the beam generating elements. This helps to generate light beams with a varying beam width and/or divergence.

Figure 1B:
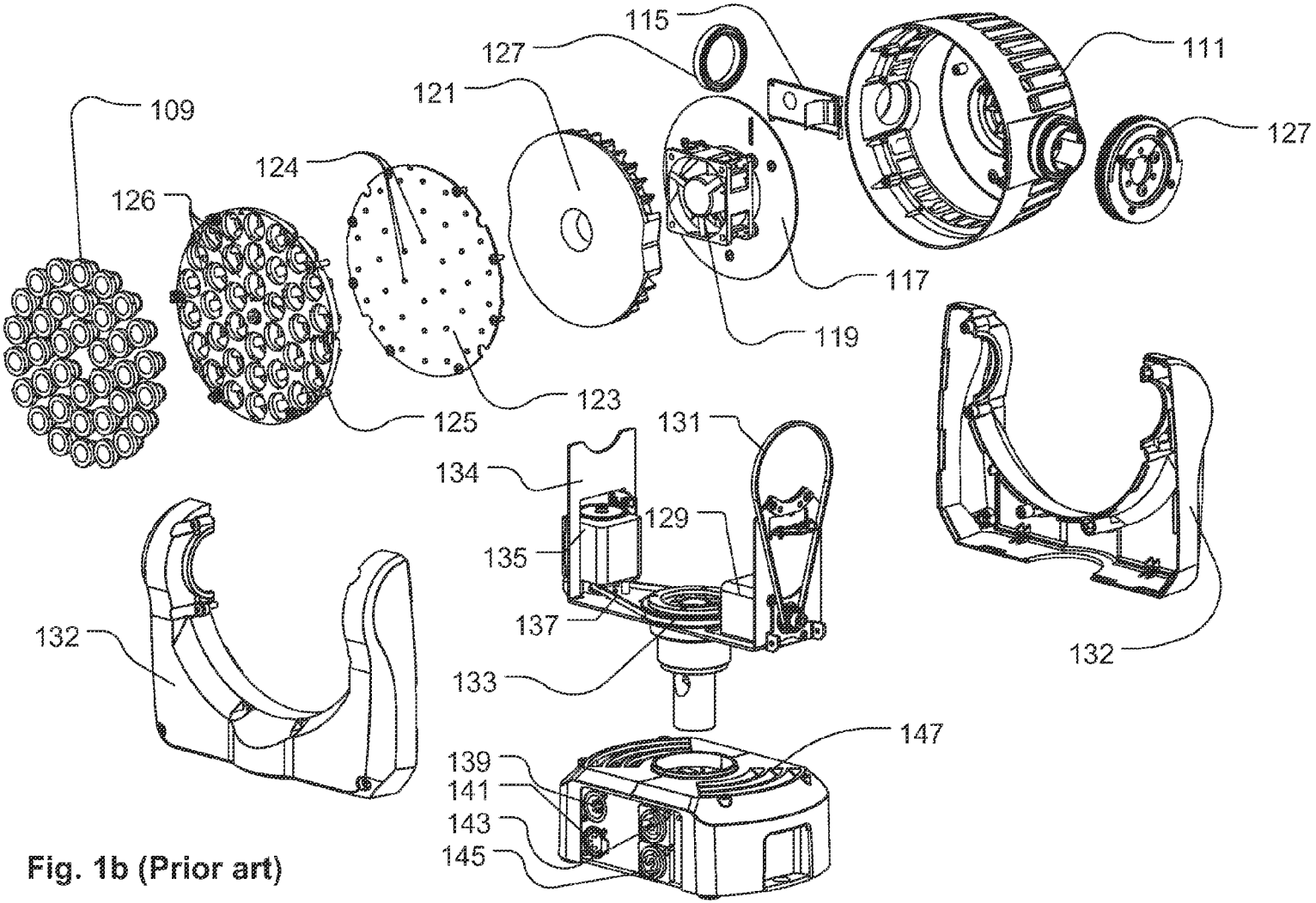
Fig. 1b (Prior art)

FIG. 1*a*-1*b* illustrate an illumination device according to prior art, where FIG. 1*a* is a perspective view and FIG. 1*b* is an exploded view. The illumination device is a moving head lighting fixture 101 comprising a base 103, a yoke 105 rotatable connected to the base and a head rotatable connected 107 to the yoke.

In the illustrated embodiment, the head comprises a number of light sources and a number of optical lenses 109 arranged in the head housing 111. The light collecting means collect light from at the light sources and convert the collected light into a number of source light beams 113 (one being illustrated in FIG. 1), which are emitted from the housing.

In the illustrated embodiment the head housing 107 is a "bucket" shaped head housing 111 wherein a display 115 (visible from the rear side of the head), main PCB 117 (Printed Circuit Board), a fan 119, a heat sink 121, an LED PCB 123, and lens assembly are stacked. The LED PCB 123 comprises a number of LEDs 124 and the lens assembly comprises a lens holder 125 with diffuser regions 126 and a lens array where the lenses constitute the light collecting means 109. Each light collecting means is adapted to collect light form one LED and convert the collected light into a number of light source beams 113. The head is rotatable connected to the yoke by two tilt bearings 127, which are supported by the yoke 105. A tilt motor 129 is adapted to rotate the head through a tilt belt 131 connected to one of the tilt bearings 127. The yoke comprises two interlocked yoke shell parts 132 which are mounted to a yoke frame 134 where on the tilt bearings, tilt motor, pan motor and pan bearing are arranged. The LED PCB 123 comprises a number of LEDs emitting light and which in cooperation with the light collecting means 109 in the lens array generate a number of light source beams. The main PCB comprises controlling circuits and driving circuits (not shown) for controlling the LEDs as known in the art of illumination devices. The main PCB comprises further a number of switches (not shown) which extend through a number of holes in the head housing 111. The switches and display act as a user interface allowing a user to communicate with the moving head lighting fixture.

The yoke is connected to a pan bearing 133 rotatable connected to the base 103. A pan motor 135 is adapted to rotate the yoke through a pan belt 137 connected to the pan bearing 133. The base comprises 5-Pin XLR male 139 and female 141 connectors for DMX signals as known in the art of entertainment lighting, input 143 and output power 145 connectors, power supply PCB's (not shown) and fan (not shown). The fan forces air into the base through vent holes 147.

This prior art illumination device of FIG. 1 uses multiple LEDs to replace a single light source as known prior the introduction of the LED component as a widely used light source. However such illumination device changes its visible appearance as the multiple light sources are now exposed to the viewer and the light emits from a larger area. If the light luminaries are a colour mixing version with single colour LEDs, then all LED colours used are visible. However some customers dislike the look of multiple light dots. Instead, a more uniform, even light exit is requested to avoid a look with an extreme amount of light sources.

The illuminating device illustrated in FIGS. 1*a* and 1*b* is just one example of a prior art illumination derive and the skilled person realize that a large number of different embodiments provided by a large number of manufactures exits.

FIGS. 2 to 6 show different illumination devices according to the invention, the illumination device as shown in FIGS. 2 to 6 may be integrated into a moving head as shown in FIGS. 1*a* and 1*b*. The components shown in FIGS. 2 to 6 may be incorporated into a rotatable head such as head 107 shown in FIG. 1*a*. The components shown in FIGS. 2 to 6 may further comprise a moving head fixture such as the fixture 101 with a base such as base 103, a yoke such as yoke 105 which is rotatably connected to the base in a head 107.

Figure 2:
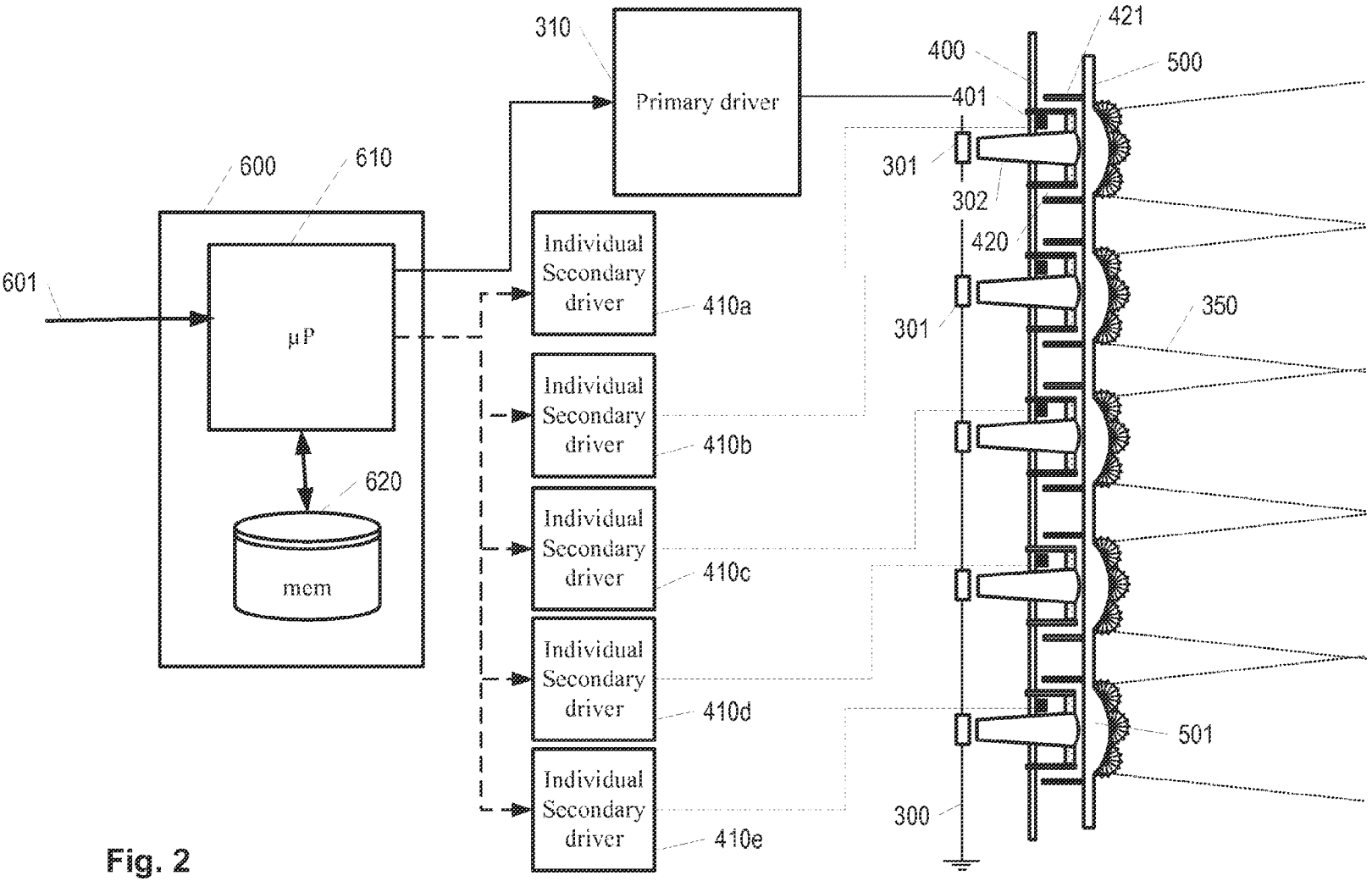
FIG. 2 is a structural diagram of an embodiment of an illumination device incorporating features of the present invention.
Figure 4:
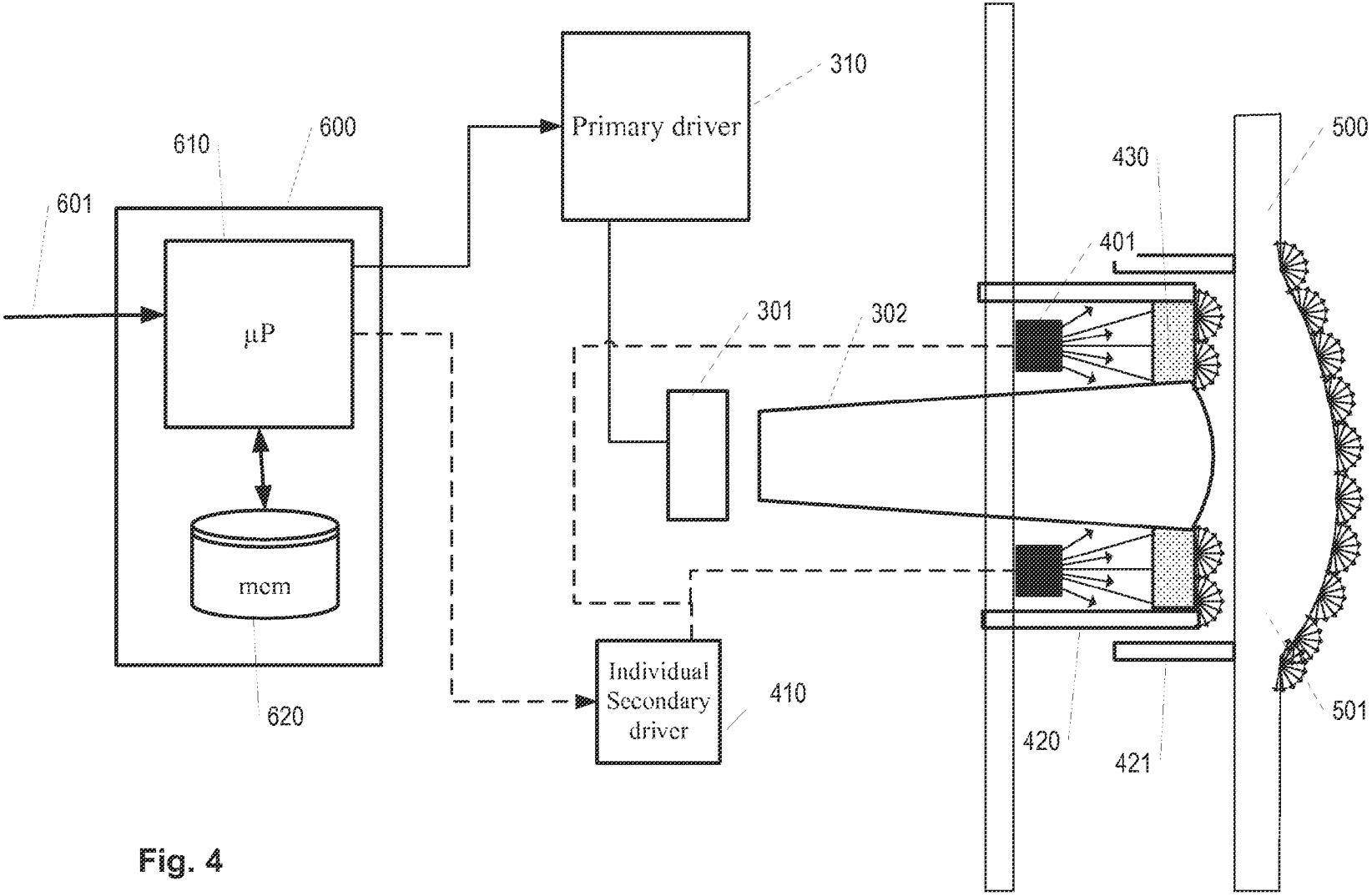
FIG. 4 shows a more detailed view of illumination of one of the optical lenses using the first or second light sources of the system shown in FIG. 3.

Referring especially to FIG. 2, the illumination device comprises a group of first light sources 301 which is provided on a circuit board 300. This group of first light sources are driven by a primary driver 310 so that a single driver is provided to drive all of the light sources 301. It is noticed that the first light sources alternatively can be driven by a plurality of drivers driving different subgroups. Furthermore, a group of second light sources 401 are provided on a second circuit board 400. The light generated by the group of first light sources 301 and the group of second light sources 401 passes an assembly 500 of different optical lenses 501. As will be explained in more detail further below, one first light source 301 is provided for each optical lens 501 and a subgroup of second light sources 401 are provided to illuminate one optical lens 501. In the embodiment shown in FIG. 2, only one second light source 401 is shown to illuminate a single optical lens 501. However, as shown in FIG. 4 which shows a more detailed view of the illumination of one optical lens 501, two or more second light sources 401 may be used to illuminate one optical lens. Each subgroup of second light sources which illuminates one optical lens is driven by one of the secondary drivers 410*a*-410*e*. Thus, as can be deduced from FIG. 2, each of the second light sources 401, i.e. each of the light sources illuminating one optical lens 501, can be controlled individually by one secondary driver 410. Furthermore, a central control unit 600 comprising at least one processing unit 610 is provided and which is connected to the primary drivers and the secondary drivers in order to control the light of the different light sources. The processing unit 610 is adapted to control the group of the first light sources via the primary driver 310 and is adapted to control the second light sources 401 using the different individual secondary drivers 410*a*-410*e*. The processing unit can be adapted to control the colour and/or the intensity of the light sources based on any type of communication signals known in the art of lightning, e.g. amplitude modulation. It is noticed that, instead of having one processing unit, two processing units can be provided, for instance one processing unit for each of the first light source and the second light sources. The control unit 600 can control the different light sources based on an input signal 601 in agreement with a target colour for the first and/or second light sources. The input signal 601 can be any signal and can be based on a digital light control protocol such as DMX. Further, it is noticed that a plurality of input signals can also be provided; for instance one input signal providing control parameters related to the first light sources and another input signal providing control parameters related to the second light sources. In an embodiment, the first input signal can be a DMX signal providing control parameters as known in the art of intelligent lightning, and the second signal can be a video signal providing graphical content that should be shown using the second light sources. The video signal can be any known kind of video signals and can, for instance, be based on the P3 protocol developed and provided by the applicant Martin Professional ApS. The first light sources and the second light sources may be RGBW or RGB LEDs which each comprises a red diode, green diode, blue diode and a white diode. The first light source may be, compared to the second light sources, an LED with higher power consumption, e.g. 10 W-15 W per LED, whereas the second light sources 401 are low power LEDs which require as a consequence less cooling. By way of example, each second LED as second light source may have a power consumption of 0.5 W per LED. Memory 620 may store information needed to operate the illumination device, e.g. it may store colour characteristics of the different LEDs used as first or second light sources. Furthermore, the memory may store suitable program code to be executed by the processing unit 610 so as to control the illumination device.

As explained in more detail in connection with FIG. 4, each of the optical lenses 501 of the illumination device can be illuminated in different ways. First of all, the illumination device can be illuminated using the first light source 301. For each first light source, a light collecting or beam generating element 302 is provided. The light collecting or beam generating element 302 is adapted to collect and mix the light generated by the first LED 301 and is adapted to convert the collected light into a light beam such as the light beams 350 shown in FIG. 2. When the first LEDs are used, a number of light beams 350 will thus be generated. This light beam 350 is narrow and more intense compared to the light beam generated by the second light sources, LEDs 401. As shown in FIG. 4, the light generated by each of the second light sources 401 is shielded by shielding elements 420, 421 which prevent the light from a second light source to hit another lens. The shielding element 420 has the form of a hollow body and is arranged in such a way that it encloses at least one second light source 401, in the embodiment shown in FIG. 4, two second LEDs 401. The hollow body can have the form of a cylinder, but may also have a square or hexagonal shape. This hollow body comprises at its upper end a diffusing element 430 which diffuses the light emitted by the first LEDs 401 before it passes the optical lens 501. Another shielding element 421 can be attached to the lower surface of the lens assembly 500. The shielding element helps to assure that the light of the second light sources only passes to one optical lens 501. Thus, as shown in FIG. 4 when the second light sources 401 are used to illuminate one optical lens 501, the light beam emitted by one optical lens is much broader than the light beam 350 generated by the first LEDs 301. As can be deduced from FIG. 4, the beam generating element 302 is arranged concentric to a shielding element 420. When the front side of the shielding element 420 is seen from the front side, i.e. from the optical lens 501, it can be deduced that the light generated by the first LED 301 does not pass the diffusing element 430, but is directly fed to the optical lens 501. In one embodiment, the light emitted by the second light sources 401 can be reflected on the inner surface of the shielding element 420 and the outer surface of beam generating elements 302 before passing the diffusing element 430. The reflection effect can be improved by providing the shielding elements and the outer surface of the light beam generating elements with a reflective material, for instance by a coating process. The shielding elements can also be provided as mirrors with the mirror surface being arranged towards the second light sources. The shielding element 420 helps to limit the light emitted by the light sources within one shielding element to only illuminate one optical lens 501. In other words, it prevents the light emitted by the light sources located inside the shielding element to illuminate another optical lens. As a consequence, it is possible to illuminate each of the optical lenses 501 individually by the second light sources 401, a subgroup of second light sources 401 is provided to illuminate one optical lens. A subgroup is driven by one individual secondary driver 410.

Figure 3B:
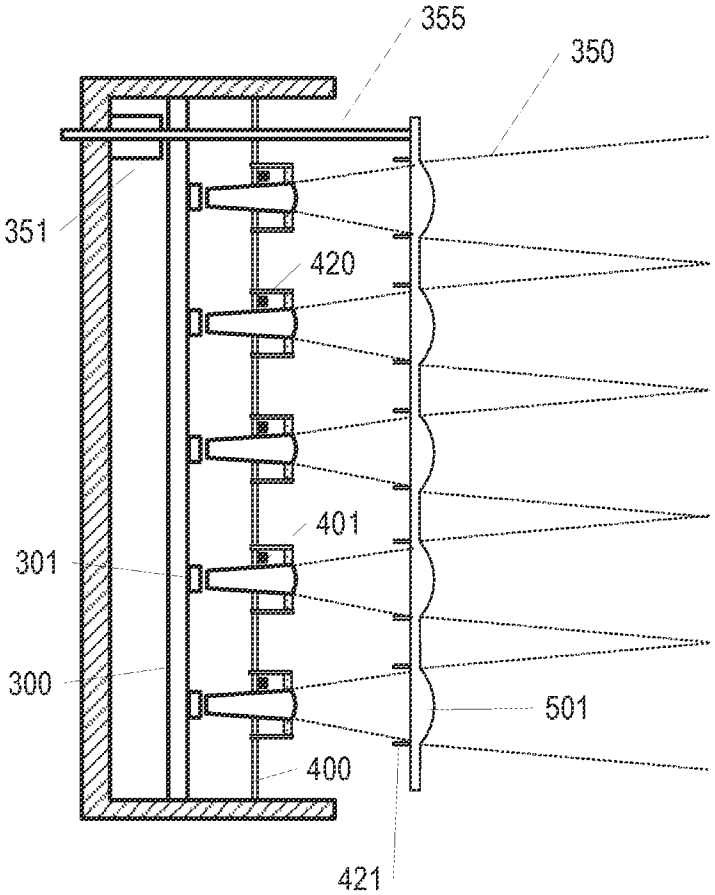
FIGS. 3*a* to 3*c* illustrate another embodiment of the illumination device of the invention including a zoom system.
Figure 3A:
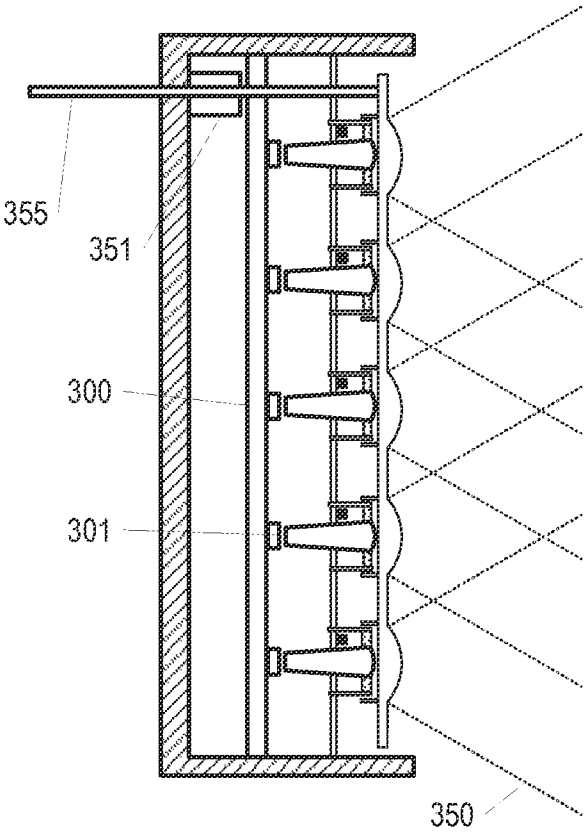

In connection with FIGS. 3*a* and 3*b*, an embodiment of an illumination device is shown. The illumination device comprises a zoom mechanism with a zoom motor or actuator 351 and a number of rods 355, with one of them being shown in FIGS. 3*a* and 3*b*. As can be deduced from FIGS. 3*a* and 3*b*, the zoom motor can vary the distance between the first light source 301 and the optical lens 501. With the changing distance between the first light source 301 and the optical lens 501, the divergence of the light beams 350 can be changed by moving the lenses back or forth. The lens assembly 500 is embodied as one transparent solid body, for instance polymer plastic. In the embodiment shown in FIG. 3*a*, a wider light beam is generated compared to the embodiment shown in FIG. 3*b*, as the distance between optical lens 501 and light source 301 is smaller in FIG. 3*a* compared to the embodiment shown in FIG. 3*b*.

Figure 3C:
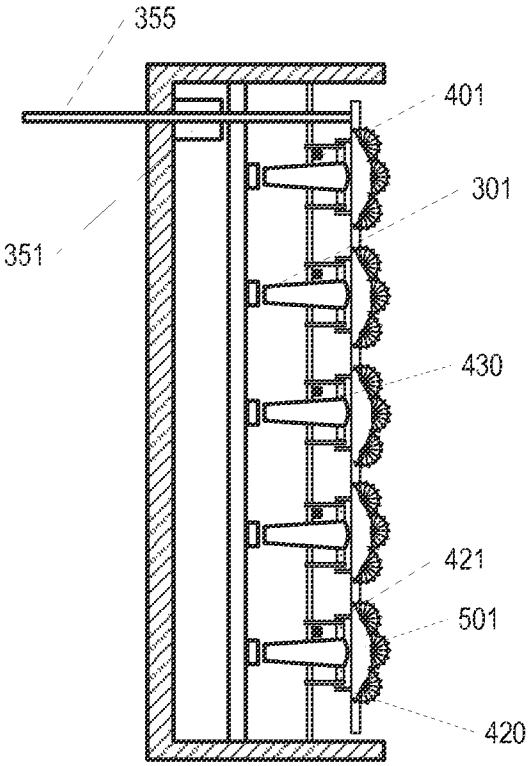

As shown in FIG. 3*c*, the embodiment with the zoom motor 350 and at least one rod 355 is shown when the light beam is generated by the second light sources 401. Due to the diffusing elements 430, the light beams generated by the second light sources 401 will be less influenced by the distance between the lens 501 and the light source 401, as the light is already diffused by the diffusing element 430. Thus, the zoom mechanism can mainly influence the light beam generated by the first light sources 301.

Figure 5A:
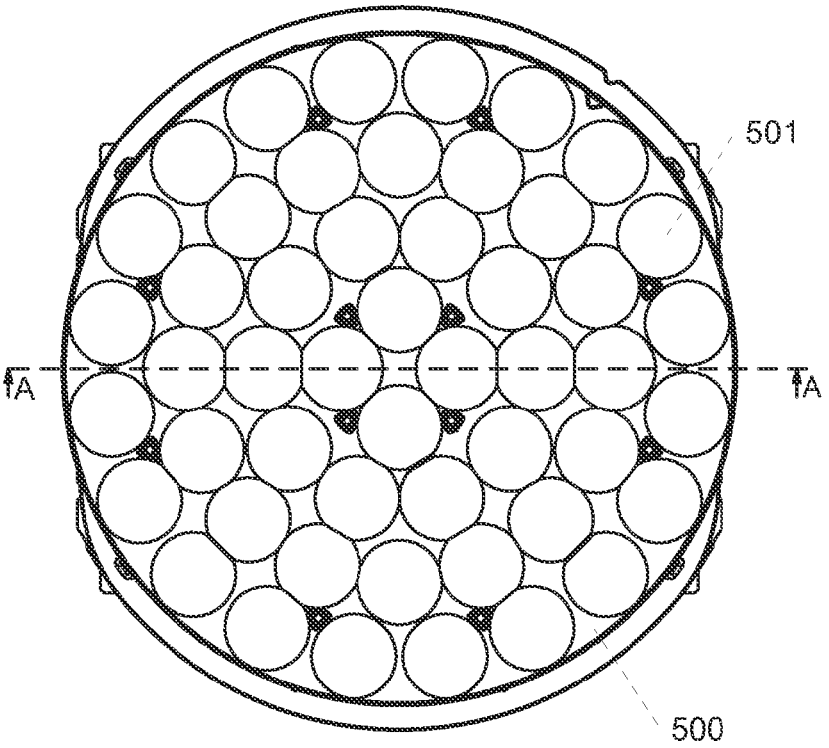
FIGS. 5*a* to 5*e* illustrate a further embodiment of an illumination device incorporating features of the invention with FIG. 5*a* being a front view, FIG. 5*b* being a front perspective view, FIG. 5*c* being a cross-sectional view through line A-A of FIG. 5*a*, FIG. 5*d* being an exploded perspective front view of the illumination device of FIG. 3, and FIG. 5*e* being an exploded rear view of the illumination device of FIG. 3.
Figure 5B:
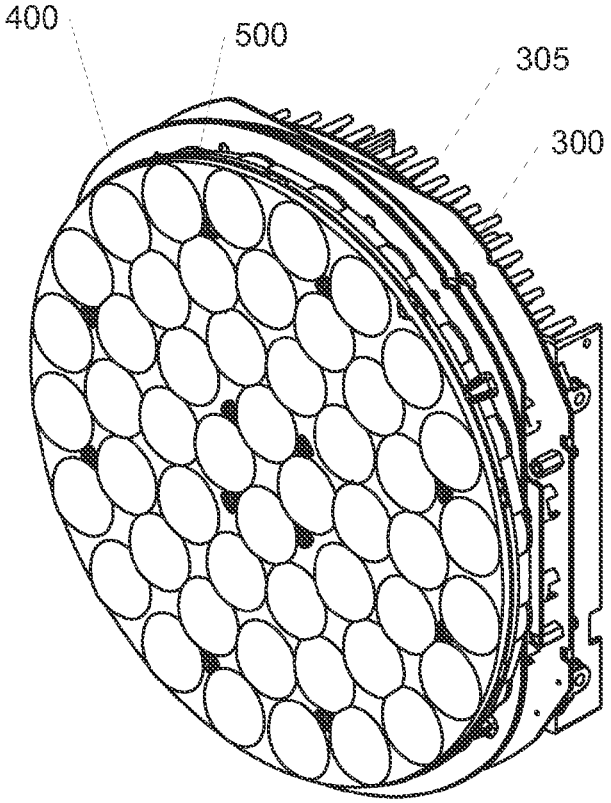
Figure 5C:
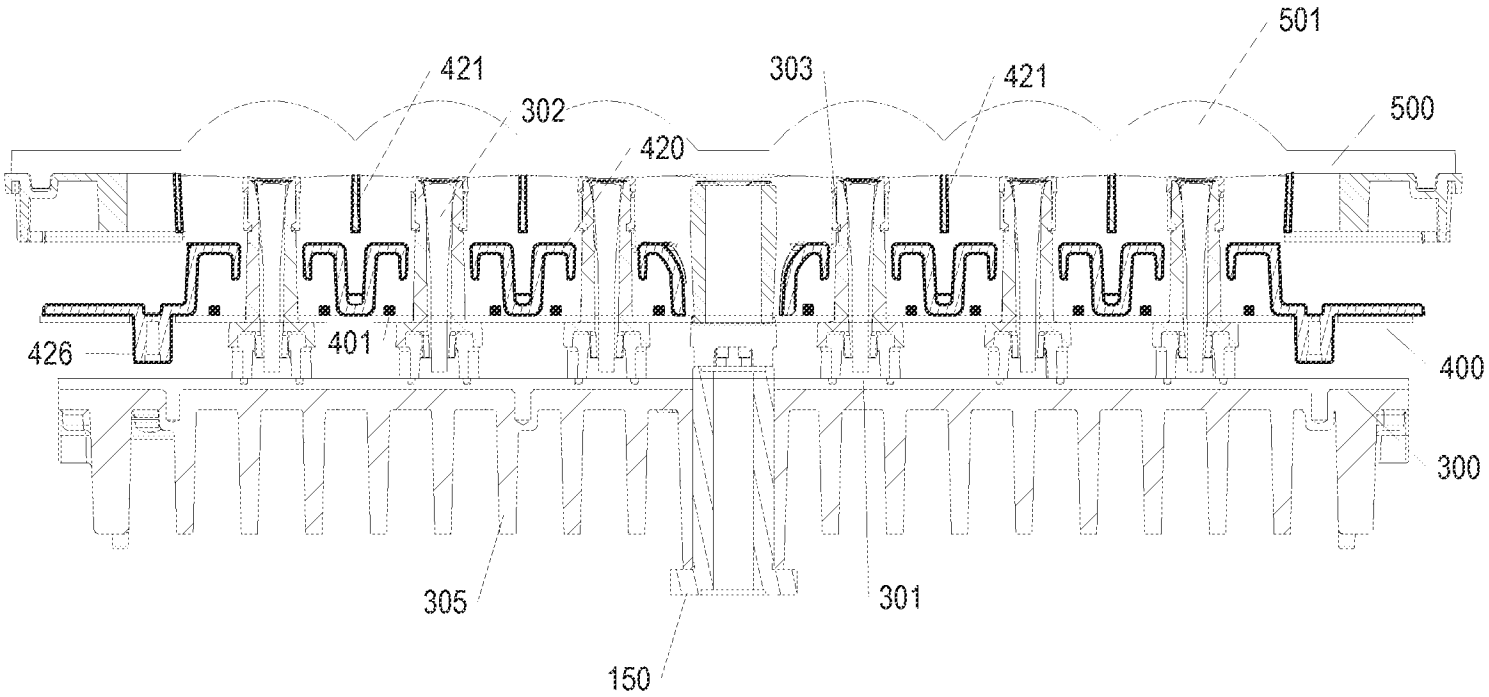
Figure 5D:
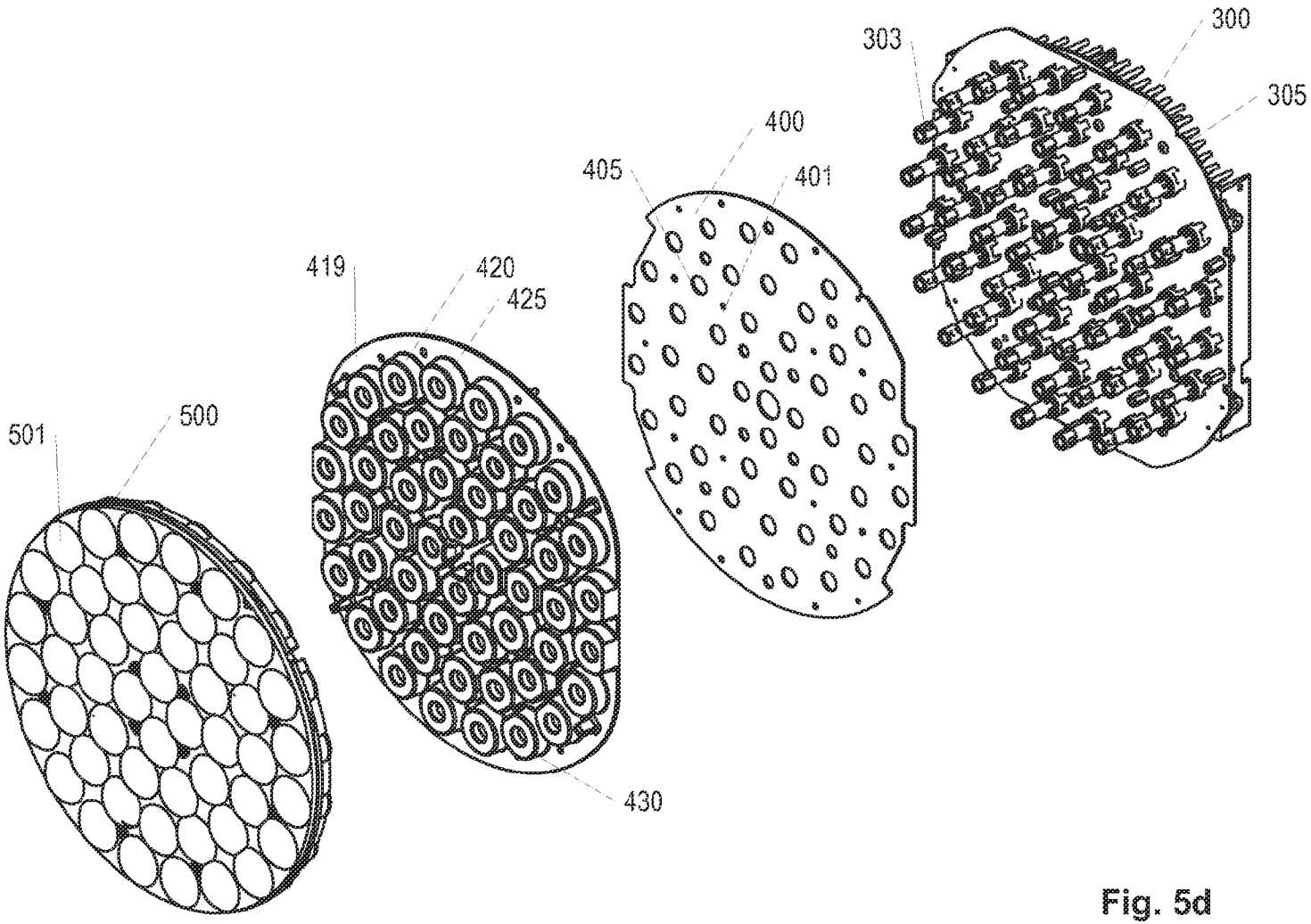

FIG. 5*d* shows in an exploded view of another illumination device. The first circuit board 300 comprises a number of first light sources 301 (not shown in FIG. 5*d*) wherein different holding elements 303 are located on the circuit board 300 above each first LED in order to hold a corresponding beam generating element 302. The holding element 303 is adapted to position each beam generating element above one first LED. As described above, the beam generating element 302 collects, mixes and converts the collected light into a light beam. Heat sink 305 maybe provided to guide the heat away from the circuit board 300. Above the circuit board 300, a second circuit board 400 is provided, the second circuit board 400 providing openings 405 through which the beam generating elements 302 are passed. On the second circuit board 400, the second light sources 401 are provided. In order to assure that the light generated by one second light source 401 or subgroup of second light sources illuminate a single optical lens 501, a shielding support 419 is provided comprising the different hollow shielding elements 420. As shown in FIG. 5*d*, each shielding element 420 is formed as a hollow cylinder with an opening 425 in the middle for a beam generating element 302. The other part of the upper surface of the cylindrically shaped body is covered by diffusing element 430 which diffuses the light generated by second light sources 401 before passing through one of the optical lenses 501.

Figure 5E:
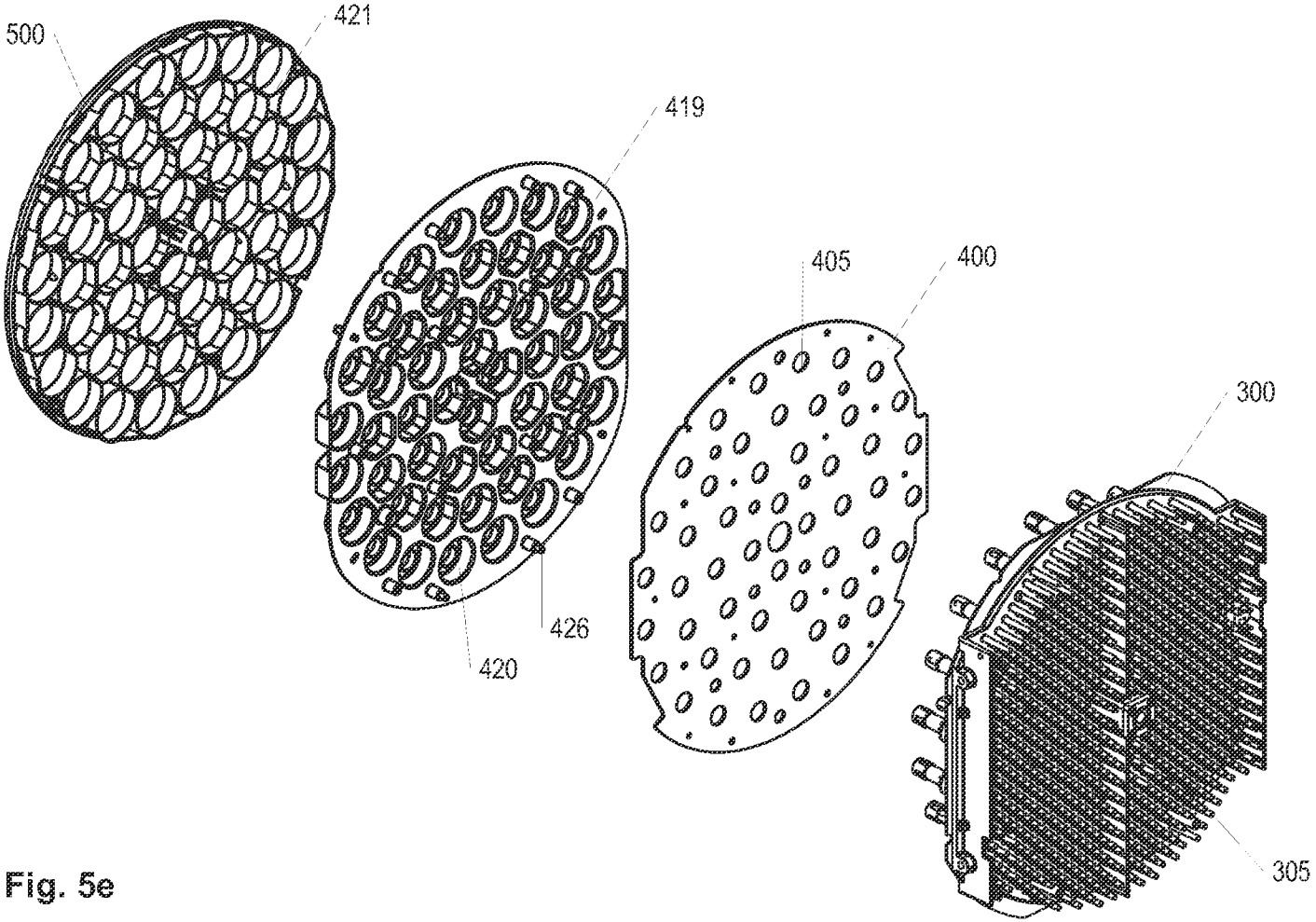

In FIG. 5*e*, an exploded perspective view from the rear side is shown. The heat sink 305 helps to anticipate the heat generated by the first LEDs 301 on circuit board 300. These LEDs have higher power consumption than the second LEDs provided on the second circuit board 400. By way of example, the first LEDs on the circuit board 300 may each have a power consumption of 10 W-15 W, whereas the second LEDs 401 may have a power consumption of 0.5 W per LED. In FIG. 5*e*, the cylindrically shaped shielding elements 420 can be seen from the rear side. Connecting elements 426 have to connect the shielding elements to the second circuit board. FIG. 5*e* furthermore shows the shielding elements 421 provided on the lower side of the lens assembly 500, which, in combination with shielding elements 420, help to guide the light of a second LED to a single lens 501.

FIG. 5*a* shows a front view of the illumination device where the different optical lenses 501 are located. Each of the lenses 501 can be illuminated using the second LEDs 401 or using the first LEDs 301. Each lens can be illuminated individually with a different colour and/or intensity. When the first LEDs 301 are used to illuminate a lens 501, a beam such as beam 350 shown in FIG. 3*a* or 3*b* is obtained, the opening angle depending on the distance of the lens 501 to the first LEDs 301 determined by the zoom mechanism. When the second LEDS 401 are used, a less focused beam is obtained. An observer will not identify light visible light beams and see the illuminated optical lenses as pixels. An observer will not identify the different light points, as the diffusion element provided between the second LED 401 and the lens 501 will help to generate a more homogenous light, as the diffusing element smoothens out the light from the second light sources such that the optical lenses appear as a single homogenous lens. A more homogenous illumination of each optical lens 501 by the second LEDs 401 is obtained when more than one LED per optical lens 501 is used, e.g. as shown in FIG. 4, where two LEDs are used. However, it should be understood that more than two LEDs per optical lens may be used which are enclosed by one shielding element. FIG. 5*c* is a sectional view along A-A of FIG. 5*a*. In the sectional view of FIG. 5*c*, it is shown how the light from a first LED 301 (not visible in FIG. 5*c*) is guided through the beam generating element 302 to one of the lenses 501. The shielding elements 420 and 421 can reflect the light of the second LEDs 401 to one of the optical lenses 501. A hole 150 is provided in the cooling plate and PCB and a zoom axle can be connected to the front lenses through this hole.

The above described embodiments provide different possibilities to illuminate the optical lenses. With the first LEDs, a narrower beam is obtained compared to the embodiment where the second LEDs are used. Furthermore, with the second LEDs, the dot-like appearance of the light sources can be avoided.

The claimed invention is:

1. An illumination device, comprising:

a group of first light sources;

a plurality of optical lenses;

a plurality of beam generating elements, wherein each of the beam generating elements is configured to collect light from at least one first light source to generate a light beam comprising the collected light and to pass the generated light beam to one of the optical lenses;

a group of second light sources; and a plurality of shielding elements, wherein:

each shielding element is arranged between at least one of the second light sources and one of the optical lenses such that the at least one of the second light source illuminates only the one of the optical lenses, each shielding element comprises a hollow body enclosing at least one second light source, and each hollow body is arranged coaxially to one beam generating element through which light from at least one first light source is passed to one optical lens.

2. The illumination device according to claim 1, further comprising a plurality of diffusing elements, wherein each of the diffusing elements is arranged between at least one second light source and a corresponding optical lens such that light emitted by said at least one second light source passes through the diffusing element before passing through the corresponding optical lens.

3. The illumination device according to claim 2, wherein each diffusing element comprises an aperture through which a corresponding beam generating elements passes.

4. The illumination device according to claim 1, wherein the group of first light sources is arranged on a first circuit board, and the group of second light sources is arranged on a second circuit board.

5. The illumination device according to claim 1, wherein each hollow body has a first end surface located on a circuit board, and a second end surface on which at least one diffusing element is arranged.

6. The illumination device according to claim 1, further comprising:

a first driver configured to drive the group of first light sources; and a plurality of second drivers configured to drive the group of second light sources, wherein a different subgroup of second light sources is configured to illuminate a different one of the plurality of optical lenses, and a different second driver is configured to drive each different subgroup of second light sources.

7. The illumination device according claim 1, wherein electric power used to drive each of the first light sources is at least 10 times greater than electric power used to drive each of the second light sources.

8. The illumination device according to claim 1, wherein the first light sources are provided on a first circuit board, and the second light sources are provided on a second circuit board, and wherein the second light sources are located between the first light sources and the plurality of optical lenses, and the first light sources are arranged to transmit light to the plurality of optical lenses behind the second light sources.

9. The illumination device according to claim 1, wherein each shielding element encloses at least two second light sources such so that at least two second light sources illuminate one optical lens.

10. The illumination device according to claim 1, further comprising an actuator configured to move said plurality of optical lenses relative to the beam generating elements.

* * * * *